United States Patent [19]

Skarman et al.

[11] Patent Number: 4,570,155

[45] Date of Patent: Feb. 11, 1986

[54] SMOKE ALARM ACTIVATED LIGHT

[75] Inventors: John S. Skarman, Newport Beach; Neal L. Tenhulzen, Signal Hill, both of Calif.

[73] Assignee: Gateway Scientific, Inc., Irvine, Calif.

[21] Appl. No.: 424,584

[22] Filed: Sep. 27, 1982

[51] Int. Cl.[4] ..... G08B 1/00; G08B 5/00

[52] U.S. Cl. ..... 340/531; 315/156; 315/241 S; 340/331; 340/628; 362/86

[58] Field of Search ..... 340/628, 531, 546, 693, 340/331, 539, 526; 358/108; 367/198; 315/156, 241 S; 362/86

[56] References Cited

U.S. PATENT DOCUMENTS

| | | | |
|---|---|---|---|
| 4,029,994 | 6/1977 | Iwans | 340/331 X |
| 4,042,919 | 8/1977 | Patty | 340/331 X |
| 4,074,225 | 2/1978 | Vandeweghe | 358/108 X |
| 4,283,657 | 8/1981 | Gordon et al. | 340/331 X |
| 4,417,235 | 11/1983 | Del Grande | 340/628 X |
| 4,419,658 | 12/1983 | Jarosz et al. | 340/693 X |
| 4,438,428 | 3/1984 | Ober et al. | 340/546 X |
| 4,450,436 | 5/1984 | Massa | 340/531 |

*Primary Examiner*—James L. Rowland
*Assistant Examiner*—Daniel Myer
*Attorney, Agent, or Firm*—Spensley, Horn, Jubas & Lubitz

[57] ABSTRACT

A portable light for emergency illumination which is activated in response to the sound emitted by a smoke alarm device, which light has an efficient and reliable battery conserving circuit. The present light includes a switch interconnecting a battery and a light bulb for selectively activating the light bulb and a circuit interconnecting a microphone and the switch for selectively activating the switch in response to a smoke alarm signal. A strobe circuit interconnects the source of power and the circuit for periodically activating the circuit which, therefore, draws power for only a small fraction of the time.

11 Claims, 2 Drawing Figures

SMOKE ALARM ACTIVATED LIGHT

BACKGROUND OF THE INVENTION

1. Field Of The Invention

The present invention relates to a smoke alarm activated light and, more particularly, to a portable light mountable on a wall which is illuminated in response to the audible signal of a smoke alarm device.

2. Description of the Prior Art

Smoke alarm devices have come into widespread use in both residential and commercial establishments in order to alert the occupants to take emergency action in the earliest stages in the development of a fire. By signalling a loud, audible alarm upon the detection of a fire, a structure can be evacuated in an orderly manner. In the daytime, there is generally no problem in doing so because there is adequate light for one to see their way. However, if the occupants of a building are aroused from sleep by an alarm from a smoke detector, there is likely to be confusion and the possibility of an inability to see in attempting to escape from the building. Further, injuries from obstacles unseen in the darkness are a possibility as the occupants move about in attempting to find light switches to evacuate the structure.

In response to this additional need, portable lamps have been developed which are illuminated in response to the frequency of a smoke alarm whereby evacuation from a burning building at night is made more safe. Such devices provide a portable light for emergency illumination which is activated in response to the sound emitted by a smoke alarm device. Such a smoke alarm activated portable light is disclosed and claimed in Robert J. Scott, et al. U.S. Pat. No. 4,258,291 issued Mar. 24, 1981.

It is much preferred that such a light be battery operated. This substantially simplifies the light, eliminates the need for various approvals, and permits it to be mounted in any convenient location. On the other hand, making the light battery operated creates the significant problem of designing a system that will provide a significant period of battery life. With current technology and the circuitry necessary for interconnecting a microphone responsive to the smoke alarm sound signal, the light, and the battery, the current drain would run the battery down within a matter of weeks if the circuit was permitted to operate at all times.

As a result, the smoke alarm activated portable lamp of the Scott et al patent includes light activated circuitry, including a photocell, for rendering the circuit unresponsive to a sound signal during illumination of the light activated circuitry to thereby conserve battery power. The photocell drives an amplifier which is operative to saturate or overdrive the first gain stage of the light activating circuitry to override any signal from the microphone whereby the lamp is rendered unresponsive to the smoke alarm signal upon illumination of the photocell by daylight or artificial light.

The obvious theory of the Scott et al patent is that when there is adequate light to permit the occupants of the building to safely exit therefrom, the portable light may be rendered unresponsive to a smoke alarm sound signal to conserve battery power. However, this has proven to be an unsatisfactory solution to the problem for a variety of reasons. First of all, there are occasions when a room does not receive daylight or artificial illumination for a significant period of time during each day so that the battery wears out very quickly. There are also instances when on a dark day or depending on where the device is located, there is a low enough light level that the circuit will turn on and draw power in a situation that would be unnecessary. Therefore, there are many instances when the circuit is unnecessarily draining the battery. Furthermore, even under normal operating circumstances, the circuit is on all night long so that the battery life has proven to be quite short.

Another problem with using a photocell activated battery saving circuit is in calibration of the photocell. Based upon the wide variety of light levels within a home, the sensitivity of the photocell becomes a significant factor, decreasing the chances of a reliable system.

SUMMARY OF THE INVENTION

According to the present invention, these problems are solved by providing a portable light for emergency illumination which is activated in response to the sound emitted by a smoke alarm device, which light has an efficient and reliable battery conserving circuit. The present light includes a switch interconnecting the battery and a light bulb for selectively activating the light bulb and a circuit interconnecting a microphone and the switch for selectively activating the switch in response to a smoke alarm sound signal. The principle of the present invention is that the circuit which interconnects the microphone and the switch need not be on all of the time. It is satisfactory if the circuit is periodically turned on, for a short period of time, to determine whether the microphone has responded to a smoke alarm sound signal. By removing all power from the circuit except for a very small fraction of the time, power consumption is significantly reduced. Furthermore, a high degree of noise immunity is also introduced because there is a significant likelihood that the microphone will be turned off during the times of occurrence of spurious sound signals.

Briefly, the present light which is activated by the sound signal of a smoke alarm comprises a microphone, a light bulb, a source of power, preferably a battery, a switch interconnecting the source of power and the light bulb for activating the light bulb when the switch is closed, circuit means for interconnecting the microphone and the switch for selectively closing the switch in response to a smoke alarm sound signal, and a strobe circuit interconnecting the source of power and the circuit means for periodically activating the circuit means so that the circuit means is operative and drawing power only for a small percentage of the time.

OBJECTS, FEATURES AND ADVANTAGES

It is therefore the object of the present invention to solve the problems associated with conserving power in a portable light activated by the sound signal of a smoke alarm. It is a feature of the present invention to solve these problems by incorporating a strobe circuit into the light so that the circuitry for activating the light is on and drawing power for only a fraction of the time. An advantage to be derived is a battery which will last for approximately a year. Another advantage is a circuit which is reliable. Still another advantage is a circuit which discriminates against spurious signals.

Another advantage is a circuit having a high level of false alarm immunity. Still another advantage is a circuit which is not subject to varying light conditions.

Still another advantage is a circuit which can be calibrated simply and easily.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
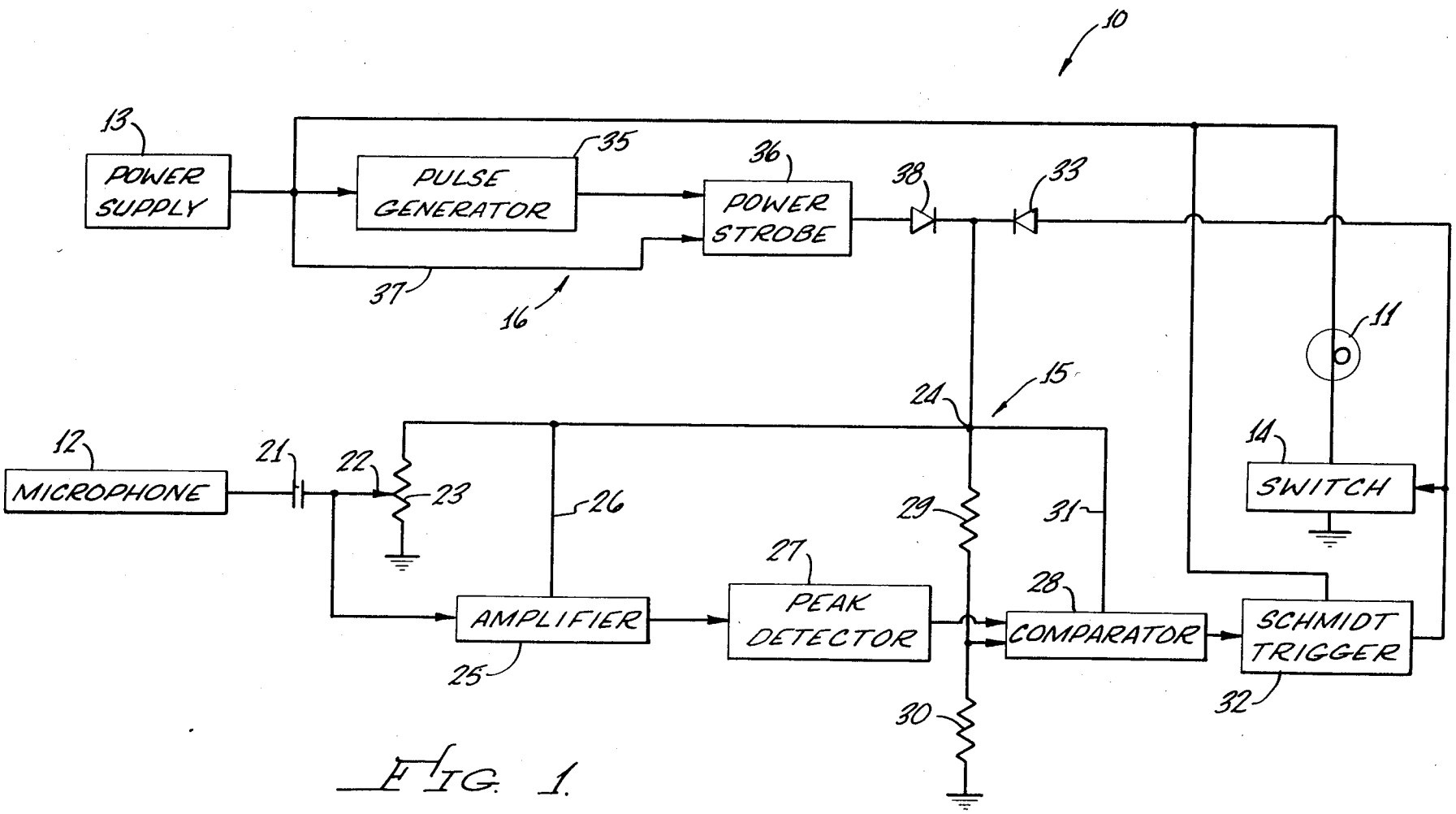
FIG. 1 is a schematic diagram, predominately in block diagram form, showing the present circuit for activating a light in response to the sound signal of a smoke alarm, including the power saving circuit thereof.

Referring now to the drawings and, more particularly, to FIG. 1 thereof, there is shown a smoke alarm activated light, generally designated 10, including a light bulb 11 responsive to the sound of a smoke alarm device for providing illumination for evacuation of a building in response to the alarm. Light 10 includes a microphone 12 and a power supply 13, preferably a DC battery. Light 10 also includes a switch 14 which interconnects power supply 13 and light bulb 11 for turning light bulb 11 on and off. Light 10 also includes circuit means, generally designated 15, which interconnects microphone 12 and switch 14 for selectively activating switch 14 in response to the detection of the sound signal from a smoke alarm device. Finally, light 10 includes circuit means, generally designated 16, for interconnecting power supply 13 and circuit means 15 for periodically activating circuit means 15 for only a fraction of the time. In this manner, circuit means 15 draws power for only a fraction of the time and the life of power supply battery 13 is substantially increased. Furthermore, by being on only a fraction of the time, light 10 has a high degree of false alarm immunity.

All of the components of light 10 may be mounted in a suitable housing (not shown), which would be positionable on a bracket (not shown), in spaced relation to a smoke alarm device (not shown). Such housing would evidently be positioned at a location to provide illumination where it would be necessary to permit occupants of a building aroused from sleep by the alarm from the smoke detector to safely evacuate the building.

The majority of smoke detectors produced today use a piezoelectric alarm having a sound signal lying in the range of from 2.7 to 3.2 kHz. Accordingly, in order to provide light 10 with a high level of false alarm immunity, it is necessary that light 10 be frequency selective. This can be achieved in a variety of ways. Scott et al suggests the use of a frequency selective microphone. This is certainly a possibility if such a microphone is available. Another possibility is to provide circuit means 15 with suitable band pass filters. Still another possibility is to mount microphone 12 in an acoustic cavity which will render microphone 12 responsive only to signals in the 2.7 to 3.2 kHz range. This is the preferred approach of the present invention.

The output of microphone 12 is connected via a capacitor 21 to the slider 22 of a potentiometer 23 connected between a junction 24 and circuit ground. Slider 22 is also connected to the input of an amplifier 25 which receives power over a line 26 connected to junction 24. The output of amplifier 25 is connected to a peak detector 27, the output of which is connected as one input to a comparator circuit 28. The other input to comparator 28 is connected to the junction between a pair of resistors 29 and 30 connected between junction 24 and circuit ground. Comparator 28 receives power over a line 31 connected to junction 24. The output of comparator 28 is connected to a Schmidt trigger circuit 32, the output of which is coupled to switch 14 to activate same. The output of Schmidt trigger 32 is also connected via a diode 33 to junction 24.

The output of power supply 13 is connected to provide power to Schmidt trigger 32 as well as to provide one input to light bulb 11, the other side of which is connected via switch 14 to circuit ground. The output of power supply 13 is also connected to a pulse generator 35 which periodically generates a very narrow pulse. For example, pulse generator 35 can generate a pulse having a width of a few microseconds once every ten to fifteen seconds. The output of pulse generator 35 is coupled to a power strobe circuit 36 which is preferably a conventional monostable multivibrator. Power strobe 36 also receives an input over a line 37 from power supply 13. Accordingly, every time pulse generator 35 generates its pulse, power strobe 36 conducts the DC signal from power supply 13 via a diode 38 to junction 24. By way of example, power strobe 36 can conduct the voltage from power supply 13 to junction 24 for approximately one second every time it is triggered by pulse generator 35.

The fundamental operation of light 10 is as follows. Microphone 12 is preferably a crystal microphone which generates a voltage in response to a sound signal without requiring any power. The output of microphone 12 is coupled via a capacitor 21 to the input of amplifier 25. Capacitor 21 simply blocks the DC voltage at junction 24 from being applied to microphone 12. The input of amplifier 25 is also connected to slider 22 of potentiometer 23 which is connected between junction 24 and circuit ground. This performs two functions. First of all, slider 22 provides a portion of the DC voltage to the input of amplifier 25 to establish its operating level. Secondly, a portion of the signal from microphone 12 is being shunted to ground. The remaining portion, which is an AC signal, is superimposed on the DC input to amplifier 25. Accordingly, as potentiometer 22 is adjusted, not only is the DC input level thereto adjusted, but also the amount of signal from amplifier 12 is also adjusted. Thus, by simultaneously varying the bias point and the amount of signal from microphone 12, light 10 can be simply calibrated.

Amplifier 25 receives power over line 26 from junction 24 and amplifies the signal from microphone 12. Since this signal is an AC signal superimposed on a DC signal, the peak of the AC signal is detected by peak detector 27 which provides a DC signal to one input of comparator 28. The other input to comparator 28 is a fixed reference signal which is a portion of the DC level at junction 24, determined by the ratio between resistors 29 and 30. Accordingly, as soon as the signal from peak detector 27 exceeds the reference signal, comparator 28, which also receives power from junction 24, triggers Schmidt trigger circuit 32 which derives its power directly from power supply 13. Schmidt trigger 32 activates switch 14, thereby completing the circuit between power supply 13 and circuit ground via light bulb 11. The purpose of Schmidt trigger 32 is to prevent light bulb 11 from chattering on and off since a Schmidt trigger circuit is turned on at one voltage level and turned off at a different voltage level.

The above description assumes that there is a DC voltage at junction 24 at all times. In practice, this is not the case. Power supply 13 activates pulse generator 55 which generates a narrow pulse once every ten to fifteen seconds. Upon the generation of this pulse, power strobe 36 switches on for approximately one second, conducting the voltage from power supply 13 to junction 24 via diode 38. Thus, potentiometer 23, amplifier 25, voltage divider 29, 30 and comparator 28 receive power for only one second every ten to fifteen seconds and this is the manner in which light 10 conserves power.

Without additional circuitry, light 11 would only stay on during the time of power strobe 36 and this would be unsatisfactory. Therefore, it is necessary that circuit 15 continuously monitor the output of microphone 12 as soon as circuit 32 is triggered. Accordingly, when Schmidt trigger 32 is triggered, it applies the output voltage from power supply 13 back to junction 24 via diode 33. Therefore, even though power strobe 36 shuts off after approximately one second, voltage is continuously applied to junction 24 to maintain circuit means 15 in operation. Circuit means 15 will remain in operation until comparator 28 senses that the output of peak detector 27 has fallen below the reference level, causing deactivation of Schmidt trigger 32. This removes the voltage being conducted by Schmidt trigger 32 to junction 24 and light 10 continues its normal strobe operation.

Figure 2:
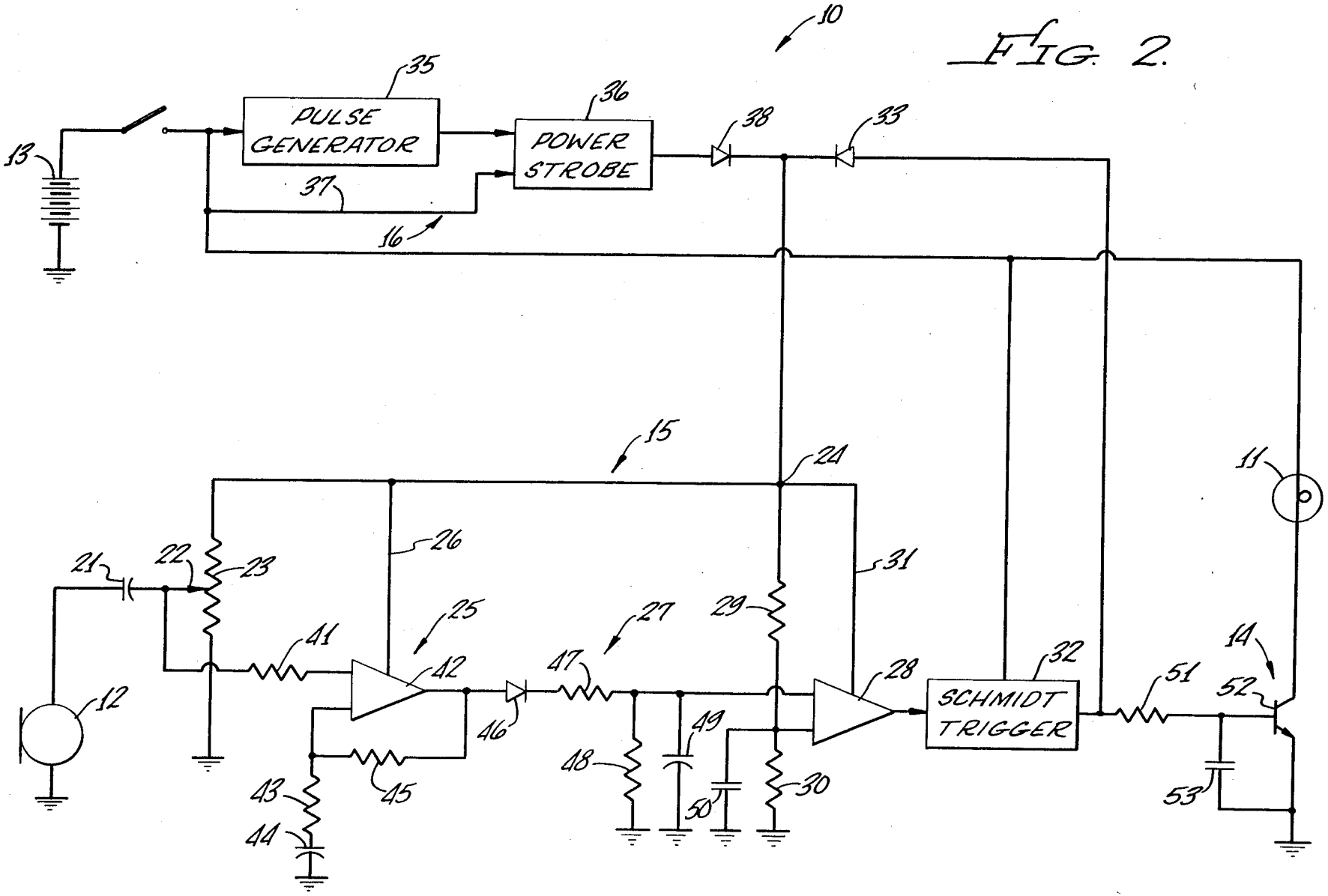
FIG. 2 is a schematic diagram, like FIG. 1, but including more of the circuitry of the present light.

A more detailed diagram of light 10 is shown in FIG. 2 which, more specifically, shows some of the circuit details of circuit 15 and switch 14. More specifically, slider 22 of potentiometer 23 is connected via an isolation resistor 41 to one input of a standard non-inverting operational amplifier 42. The other input of amplifier 42 is connected to circuit ground via a resistor 43 and a capacitor 44. A feedback resistor 45 is connected between the output of amplifier 42 and the second input thereof.

The output of amplifier 42 is connected via a diode 46 and a resistor 47 to one input of another standard noninverting amplifier which functions as comparator 28. This input to comparator 28 is also connected to circuit ground via a resistor 48 and a capacitor 49. The other input to amplifier 28 is connected via resistor 30 and a capacitor 50 to ground.

The output of Schmidt trigger 32 is connected via a resistor 51 to the base of a transistor 52 which functions as switch 14, the emitter of transistor 52 being connected to ground and the collector being connected to light bulb 11. A capacitor 53 is connected between the base and emitter of transistor 52.

In operation, amplifier 25 is a standard noninverting amplifier, except for the addition of capacitor 44. Capacitor 44 is added to provide additional frequency selectivity to circuit 15. That is, capacitor 44 operates as a DC open circuit so that amplifier 25 is unresponsive to DC signals. As the frequency increases, capacitor 44 increasingly functions as a short circuit so that the value of capacitor 44 can be selected to enhance the response of amplifier 25 in the frequency range of interest, namely at frequencies above 2.7 kHz.

Amplifier 28 is biased at a reference level determined by the ratio of resistor 29 to the sum of resistors 29 and 30. For amplifier 28 to trigger, the other input thereto must exceed this reference level. In the absence of an input signal from microphone 12, the output of amplifier 42 is a DC signal determined by the setting of potentiometer 22. This signal is conducted via diode 46 and resistor 47 to the other input to amplifier 28 so that it normally is not activated. On the other hand, when microphone 12 picks up a signal in the frequency range of interest, an AC signal is superimposed on the DC signal. The positive peaks of this signal are conducted by diode 46 to capacitor 49 so that this AC signal is both rectified and filtered. Capacitor 49 begins to charge and as soon as the voltage level thereon exceeds the reference signal, circuit 32 is triggered.

As mentioned previously, trigger 32 receives power directly from power supply 13. Thus, as soon as it is triggered, it conducts this voltage via diode 33 to junction 24. It also applies a signal to the base of transistor 52 to turn it on. Capacitor 53 causes transistor 52 to turn on slowly, to eliminate transients and to maximize the life of bulb 11.

It can therefore be seen that according to the present invention, the problems discussed previously have been solved by providing a portable light for emergency illumination which is activated in response to a sound emitted by a smoke alarm device, which light has an efficient and reliable battery conserving circuit. Light 10 includes a switch 14 interconnecting battery 13 and light bulb 11 for selectively activating light bulb 11 and a circuit 15 interconnecting microphone 12 and switch 14 for selectively activating switch 14 in response to a smoke alarm sound signal.

The principal of the present invention is that circuit 15 need not be on all of the time. It is satisfactory if circuit 15 is periodically turned on, for a short period of time, to determine whether microphone 12 has responded to a smoke alarm sound signal. By removing all power from circuit 15 except for a very small fraction of the time, power consumption is significantly reduced. Furthermore, a high degree of noise immunity is also introduced because there is a significant likelihood that microphone 12 will be turned off during the times of occurrence of spurious sound signals.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. A light activated by the sound signal of a smoke alarm comprising:

a microphone;

a light bulb;

a source of power;

switch means interconnecting said source of power and said light bulb for selectively activating said light bulb;

circuit means interconnecting said microphone and said switch means for selectively activating said switch means in response to a smoke alarm sound signal; and strobe means interconnecting said source of power and said circuit means for periodically activating said circuit means.

2. A light according to claim 1, wherein said source of power is a battery.

3. A light according to claim 1, wherein said light is selectively responsive to the frequency of the sound signal of a smoke alarm.

4. A light according to claim 1, 2 or 3, wherein the period of activation of said circuit means is significantly less than the period of deactivation of said circuit means.

5. A light according to claim 1, 2 or 3, wherein said circuit means comprises:

means responsive to the output of said microphone for amplifying the output thereof;

a peak detector responsive to the output of said amplifier;

means responsive to said source of power for establishing a reference level; and comparator means responsive to said peak detector and said reference level for generating a light-activating signal for activating said switch means when said output of said peak detector exceeds said reference level.

6. A light according to claim 5, wherein said strobe means periodically activates said amplifying means.

7. A light according to claim 6, wherein said strobe means periodically activates said comparator means.

8. A light according to claim 7, wherein said strobe means periodically activates said reference level establishing means.

9. A light according to claim 1, 2 or 3, wherein said strobe means comprises:

means responsive to said source of power for periodically generating a pulse; and means responsive to said pulse and said source of power for conducting the power from said source to said circuit means for a predetermined time interval upon the occurrence of each pulse.

10. A light according to claim 1, 2 or 3, wherein said circuit means comprises:

amplifier means; and means interconnecting said source of power, said microphone and said amplifier means for simultaneously adjusting the DC bias of said amplifier and the amount of signal from said microphone coupled to said amplifier.

11. A light according to claim 1, 2 or 3, further comprising:

means responsive to activation of said switch means by said circuit means for connecting said source of power to said circuit means until the termination of said smoke alarm sound signal.

* * * * *